US006627819B2

(12) United States Patent
Hashimoto et al.

(10) Patent No.: US 6,627,819 B2
(45) Date of Patent: Sep. 30, 2003

(54) INSULATED WIRE

(75) Inventors: Dai Hashimoto, Tokyo (JP); Masaki Nishiguchi, Tokyo (JP); Kouji Iwata, Tokyo (JP); Kiyoshi Saito, Tokyo (JP)

(73) Assignee: The Furukawa Electric Co., Ltd., Tokyo (JP)

( * ) Notice: Subject to any disclaimer, the term of this patent is extended or adjusted under 35 U.S.C. 154(b) by 0 days.

(21) Appl. No.: 09/908,919

(22) Filed: Jul. 18, 2001

(65) Prior Publication Data

US 2002/0033272 A1 Mar. 21, 2002

(30) Foreign Application Priority Data

Jul. 19, 2000 (JP) ..... 2000-219732

(51) Int. Cl.[7] ..... H01B 3/00

(52) U.S. Cl. ..... 174/110 R; 428/372; 428/375; 428/379; 428/383; 428/389

(58) Field of Search ..... 174/110 R, 120 R; 428/372, 375, 379, 383, 389; 252/511

(56) References Cited

U.S. PATENT DOCUMENTS 4,238,575 A * 12/1980 Kleiner et al. ..... 524/303
6,200,679 B1 * 3/2001 Hase et al. ..... 174/110 PM
6,294,256 B1 * 9/2001 Easter ..... 174/106 SC
6,300,415 B1 * 10/2001 Okayama et al. ..... 264/165
6,388,015 B1 * 5/2002 Aimura et al. ..... 525/193
2001/0036548 A1 * 11/2001 Halloran et al.

FOREIGN PATENT DOCUMENTS

| | | |
|---|---|---|
| JP | 05-074231 | 3/1993 |
| JP | 06-220265 | 8/1994 |
| JP | 06313071 | * 11/1994 |
| JP | 09-095566 | 4/1997 |
| JP | 10-017728 | 1/1998 |

* cited by examiner

*Primary Examiner*—Dean A. Reichard
*Assistant Examiner*—Jinhee J Lee
(74) *Attorney, Agent, or Firm*—Knobbe Martens Olson & Bear LLP

(57) ABSTRACT

An insulated wire, in which a conductor is coated with a crosslinked structure of a composition that comprises 150 to 300 parts by weight of a metal hydrate, 1 to 6 parts by weight of a phenol-series antioxidant, and 12 to 30 parts by weight of a thioether-series antioxidant, to 100 parts by weight of a base resin containing ethylene/vinyl acetate copolymer, and the content of vinyl acetate in the base resin is 40 wt % or more.

12 Claims, No Drawings

INSULATED WIRE

FIELD

The present invention relates to an insulated wire.

BACKGROUND

Insulated wires (electric wires), which are used for inner wiring of electric/electronic equipment, are required to have various characteristics, including fire retardancy, tensile properties, heat resistance, and the like. As the covering material used for these wiring materials, a polyfvinyl chloride) (PVC) compound, a polyolefin compound wherein a halogen-series fire-retardant additive containing bromine atoms or chlorine atoms in the molecule is mixed, and a crosslinked product thereof, have been mainly used.

Recently, there are presented various problems, which occur when insulated wires having such covering materials are discarded without being treated properly. For example, when they are buried, the plasticizer or the heavy metal stabilizer mixed in the covering material is oozed out; and when they are burned, a lot of corrosive gas is produced.

Therefore, techniques wherein wiring materials are covered with a halogen-free fire-retardant material that is free from any risk of oozing out of toxic plasticizers or heavy metals, or generation of a halogen-series gas or the like, are keenly investigated.

The properties required for insulated wires that can be used in electric/electronic equipment (i.e., fire retardancy, tensile properties, heat resistance, and the like) are stipulated in UL Standard (Reference Standard for Electrical Wires, Cables, and Flexible Cords), JIS, etc. Among these required properties, fire retardancy and tensile properties are known for not showing good compatibility with each other (i.e., achieving excellent fire retardancy and excellent tensile properties simultaneously is not easy).

When it is necessary to attain fire retardancy and tensile properties compatibly in an insulated wire coated with a halogen-free fire retardant material, a method can be used that employs, as a coating material, a composition to which red phosphorus has been blended as an auxiliary flame retardant, in addition to a metal hydrate as a flame retardant. However, in the wiring of electric/electronic equipment currently in use, insulated wires are often printed in their surfaces, or coated with materials colored in several colors, so that the types and the connection portions of the insulated wires can be distinguished from each other. Therefore, if red phosphorus is blended to such a coating material, there arise problems that the coating material can no longer be colored in a desired color (e.g. white), due to the color development of red phosphorus, and that printing on the surface of the insulated wire can no longer be recognized.

In recent years, as a method that avoids using red phosphorus, there has been proposed a method wherein a conductor is coated with a crosslinked product of a composition produced by blending a large amount of a metal hydrate, which has been subjected to surface treatment with a silane coupling agent, to an ethylene-series copolymer in which the contents of polar groups, such as vinyl acetate and acrylic ester, have been increased.

The crosslinking of the composition that is coated on the conductor, attained by the electron beam crosslinking method or the chemical crosslinking method, as is also performed in the aforementioned conventional method, has been generally used to improve the heat resistance property.

In particular, in order to produce an insulated wire that satisfies strict heat-aging test standards, such as UL 125° C. (after kept at 158° C.×168 hours, the tensile strength retained of the insulating material of a wire being 70% or more, and the tensile elongation retained of the insulating material of a wire being 65% or more) or UL 150° C. (after kept at 180° C.×168 hours, the tensile strength retained of the insulating material of a wire being 70% or more, and the tensile elongation retained of the insulating material of a wire being 65% or more), a method has been employed wherein, in addition to crosslinking the composition, the heat resistance of the composition is improved, by the additive effects brought about by use of a radical chain inhibitor (such as an amine-series antioxidant, a phenol-series antioxidant, or the like) in combination with a peroxide-decomposing agent (such as a sulfur-series antioxidant, a phosphorus-series antioxidant, or the like). Similarly, in the case of a fire retardant insulated wire coated with a crosslinked product of a composition produced by blending a halogen-series flame retardant to a polyolefin, a method of producing such an insulated wire, in most cases, uses a radical chain inhibitor together with a peroxide-decomposing agent, such that the resulting insulated wire satisfies the aforementioned heat aging test standards, such as UL 125° C. and UL 150° C.

However, in the case of the halogen-free fire retardant insulating wire coated with a crosslinked product of a composition produced by blending a large amount of a metal hydrate, which has been subjected to surface treatment with a silane coupling agent, to an ethylene-series copolymer, in which the contents of polar groups, such as vinyl acetate and acrylic ester, have been increased, if a radical chain inhibitor and a peroxide-decomposing agent are used in combination therein, as is the case with the aforementioned fire retardant insulated wire coated with the crosslinked product of a composition produced by blending a halogen-series flame retardant to a polyolefin, the resulting insulated wire cannot satisfy the heat aging test standards of UL 150° C., although it can meet the heat aging test standards of UL 125° C.

SUMMARY

The present invention is an insulated wire, in which a conductor is coated with a crosslinked product of a composition that comprises 150 to 300 parts by weight of a metal hydrate, 1 to 6 parts by weight of a phenol-series antioxidant and 12 to 30 parts by weight of a thioether-series antioxidant, to 100 parts by weight of a base resin containing ethylene/vinyl acetate copolymer, and the content of vinyl acetate in the base resin is 40 wt % or more.

Other and further features, and advantages of the invention will appear more fully from the following description.

DETAILED DESCRIPTION

According to the present invention, the following insulated wire is provided.

(1) An insulated wire, in which a conductor is coated with a crosslinked product of a composition that comprises in a proportion, 100 parts by weight of a base resin containing ethylene/vinyl acetate copolymer, 150 to 300 parts by weight of a metal hydrate, 1 to 6 parts by weight of a phenol-series antioxidant, and 12 to 30 parts by weight of a thioether-series antioxidant, and the content of vinyl acetate in the base resin being 40 wt % or more.

(2) The insulated wire described in the aforementioned (1), wherein the composition further contains no more than 12 parts by weight of a benzoimidazole-series antioxidant per 100 parts by weight of the base resin.

(3) The insulated wire described in the aforementioned (1) or (2), wherein the composition contains an ethylene/acryl rubber in the base resin, with the amount no more than 30 wt % of the base resin.

(4) The insulated wire described in the aforementioned (1), (2) or (3), wherein the metal hydrate has been surface-treated with a silane coupling agent.

(5) The insulated wire described in any one of the aforementioned (1) to (4), wherein the metal hydrate is magnesium hydroxide.

(6) The insulated wire described in any one of the aforementioned (1) to (5), wherein 20 wt % or more of the ethylene/vinyl acetate copolymer is an ethylene/vinyl acetate copolymer of a structure in which three or more vinyl acetate component, as a component of the copolymer, are continuously linked.

Each of the components contained in a composition that is used for coating a conductor and thereby forming an insulating material, in the present invention, will be described hereinafter.

First, a base resin in the present invention and each components contained thereof will be described.

The base resin in the present invention essentially includes (a) ethylene/vinyl acetate copolymer and may further include, according to necessity, (b) polyolefin and (c) ethylene acryl rubber. The content of vinyl acetate in the base resin is generally 40 wt % or more and preferably in the range of 50 to 70 wt %.

When the content of vinyl acetate in the base resin is too small, the adhesion between the conductor and the insulating material is deteriorated due to the thioether-series antioxidant that is blended with a large amount, whereby the terminal processing step, in which a conductor is exposed by a predetermined length by peeling the insulation coating off by that length, and is connected to a terminal or the like, may encounter a trouble. However, by setting the content of vinyl acetate in the base resin to be 40 wt % or more, the deterioration of the adhesion between the conductor and the insulating material is prevented, whereby an insulated wire, which satisfies the horizontal flame test and the 60° inclined flame test of JIS C3005 that is the standard regarding the fire retardancy of insulated wires, can be obtained.

Further, when the content of vinyl acetate is 60 wt % or more, an insulated wire, which satisfies the UL VW-1 vertical flame test that is the standard regarding the fire retardancy of insulated wires, can be obtained.

(a) Ethylene/vinyl Acetate Copolymer

There is no particular restriction to the ethylene/vinyl acetate copolymer used for the base resin in the present invention, except that the content of vinyl acetate in the base resin is set at the aforementioned ratio. Two or more types of ethylene/vinyl acetate may be used in a mixed state. When a mixture of the ethylene/vinyl acetate copolymer component and a component other than ethylene/vinyl acetate copolymer is used as a base resin, the content of vinyl acetate in the mixture can be adjusted so as to be within the aforementioned range, by employing an ethylene/vinyl acetate copolymer having a high vinyl acetate content. Further, the ethylene/vinyl acetate copolymer for use in the present invention preferably has a melt flow rate (MFR) of 0.1 to 10 g/10 minutes (in a condition of load: 21.18N (2.16 kgf) and temperature: 190° C.).

When, generally, 20 wt % or more (preferably 30 to 70 wt %) of the ethylene/vinyl acetate copolymer has a structure in which three or more vinyl acetate component as a component of the copolymer are continuously linked, the insulation resistance of the composition can be further improved, and an insulated wire that is less in deterioration of insulation resistance due to moisture absorption or water absorption can be obtained.

The structure of the ethylene/vinyl acetate copolymer can be confirmed by calculating the ratio of peak areas of $^{13}$C-NMR spectrum. The signals at 65 to 70 ppm indicate that the structure having three or more vinyl acetate components in a continuous manner is present.

Specific examples of such a ethylene/vinyl acetate copolymer include, for example, "Levapren 800HV", "Levapren 700HV", "Levapren 600HV" (all trade names, manufactured by Bayer Ltd.)

(b) Polyolefin

In the present invention, specific examples of the polyolefins that can be used in a base resin include, for example, a polyethylene, such as very low density polyethylene (VLDPE), straight-chain low-density polyethylene (LLDPE), low-density polyethylene (LDPE), middle-density polyethylene (MDPE), high-density polyethylene (HDPE); a homopolypropylene (H-PP), an ethylene/propylene block copolymer (B-PP), an ethylene/propylene random copolymer (R-PP), and those modified with an unsaturated carboxylic acid or its derivative.

Specific examples of the unsaturated carboxylic acids include, for example, maleic acid, itaconic acid, and fumaric acid. Specific examples of the derivatives of the unsaturated carboxylic acids include, for example, maleic acid monoesters, maleic acid diesters, maleic anhydrate, itaconic acid monoesters, itaconic acid diesters, itaconic anhydrate, fumaric acid monoesters, fumaric acid diesters, and fumaric anhydrate.

A polyolefin can be modified with an unsaturated carboxylic acid or the like, by, for example, melting and kneading the polyolefin and the unsaturated carboxylic acid or the like under the presence of a peroxide.

The melt flow rate (MFR) of the polyolefin is preferably 0.1 to 10 g/10 minutes (for VLDPE, LLDPE, LDPE, MDPE, HDPE: load of 21.18 N (2.16 kgf), temperature of 190° C.; for H-PP, B-PP, R-PP: load of 21.18 N (2.16 kgf), temperature of 230° C.).

When an insulated wire is produced by extrusion-coating of a composition, in which an ethylene/vinyl acetate copolymer having a high content of vinyl acetate is used, the inside of an extruder hopper or a screw feed section of an extruder are sometimes blocked by pellets, or the coating layer may be crashed or damaged by a guide roll of an extruder. However, by blending polyolefin to the composition, such troubles can be alleviated or prevented.

Two or more types of polyolefin may be used with mixing them together.

In the present invention, when the polyolefin is used, the amount thereof to be blended can be arbitrary determined, but the amount is preferably 20 wt % or less of 100 parts by weight of the base resin.

(c) Ethylene/Acryl Rubber

As the ethylene/acryl rubber used for the base resin in the present invention, a binary polymer (bipolymer) comprising ethylene and methyl acrylate or a ternary polymer (terpolymer) comprising ethylene, methyl acrylate and a carboxyl compound is preferable. Examples thereof include "Vamac D", "Vamac DLS", "vamac G" and "Vamac GLS" (all trade names, manufactured by Du Pont co.)

The ethylene/acryl rubber is blended for the purpose of improving the processability of the composition, when the components (a), (b), and (d) to (g) described below are melt-kneaded by a kneading device such as a banbury mixer, a kneader or a roll, or when a melt-kneaded composition is subjected to the extrusion-coating process by an extruder.

The ethylene/vinyl acetate copolymer having a high vinyl acetate content, which is used as the component (a), exhibits excellent adhesion property with respect to metal. Therefore, when the ethylene/vinyl acetate copolymer is melted, there arises a problem that the copolymer tends to adhere to metal portions in a kneading device and in the screw of an extruder. As a result, there may arise additional problems such as difficulty in discharging the composition from the kneading device, and non-uniform thickness of the coating layer of the insulated wire due to fluctuation of the amount of the composition discharged from the extruder. By adding ethylene/acryl rubber to the base resin, such problems can be alleviated or prevented.

In the present invention, when the ethylene/acryl rubber is used, the amount thereof to be blended is generally 30 wt % or less, preferably 5 to 15 wt %, of 100 parts by weight of the base resin.

When the blended amount of ethylene/acryl rubber is too large, the tensile strength retained of the insulating material may increase and/or the tensile elongation retained of the insulating material may decrease after the heat aging test. Especially, the excellent heat resistance that satisfies the heat aging test standard of UL 150° C. may not be attained.

(d) Metal Hydrate

In the present invention, the metal hydrate used as the fire-retardant additive includes, but is not particularly limited to, for example, compounds having a hydroxyl group or water of crystallization, such as aluminum hydroxide, magnesium hydroxide (these are metal hydroxides), aluminum silicate hydrate, magnesium silicate hydrate, basic magnesium carbonate, and hydrotalcite.

These metal hydrates can be used singly or as a combination of two or more.

Further, in the present invention, a metal hydrate that is subjected to surface treatment with a silane coupling agent, is preferably used, so that an insulated wire having excellent tensile property can be obtained.

As the silane coupling agent used for the surface treatment, known silane coupling agents that have been conventionally in use can be employed without any particular restriction. However, a silane coupling agent, having an organic functional group, such as an amino group, a methacryl group, a vinyl group, an epoxy group and a mercapto group, is preferable, and in terms of the fire retardancy and the tensile property, a silane coupling agent having a vinyl group and/or an epoxy group is further preferable.

Examples of such a silane coupling agent include vinyltris(β-methoxyethoxy)silane, vinyltriethoxysilane, vinyltrimethoxysilane, γ-(methacryloyloxypropyl) trimethoxysilane, γ-(methacryloyloxypropyl) methyldimethoxysilane, β-(3,4-epoxycyclohexyl) ethyltrimethoxysilane, γ-glycidyloxypropyltrimethoxysilane, γ-glycidoxypropylmethyldiethoxysilane, N-β-(aminoethyl)-γ-aminopropyltrimethoxysilane, N-β-(aminoethyl)-γ-aminopropylmethyldimethoxysilane, γ-aminopropyltriethoxysilane, N-phenyl-γ-aminopropyltrimethoxysilane, γ-mercaptopropyltrimethoxysilane, and the like.

When a metal hydrate that is subjected to surface treatment with a silane coupling agent is used, a metal hydrate that has been subjected to surface treatment with a silane coupling agent in advance may be blended to the composition, or a metal hydrate whose surface is untreated or has been treated may be blended to the composition, together with a silane coupling agent, to carry out surface treatment.

Here, the silane coupling agent is suitably added by the amount that is sufficient to conduct the surface treatment of the metal hydrate. Specifically, the preferable amount of the silane coupling agent to be added is 0.1 to 2.0 wt % to the metal hydrate.

Further, regarding the types of the metal hydrate, magnesium hydroxide is preferable in terms of the heat resistance. Examples thereof include "Kisuma 5", "Kisuma 5A", "Kisuma 5B", "Kisuma 5J", "Kisuma 5LH" and "Kisuma 5PH" (all trade names, manufactured by Kyowa Chemical Industry Co., Ltd.).

The amount of the metal hydrate to be blended is generally 150 to 300 parts by weight, preferably 180 to 240 parts by weight, with respect to 100 parts by weight of the base resin.

When the blended amount of the metal hydrate is too small, the fire retardancy of the degree that is required for the insulated wire used as the internal wiring of electric/electronic equipment cannot be obtained. On the other hand, when the blended amount of the metal hydrate is too large, the tensile property is deteriorated, which is not preferable.

Next, (e) phenol-series antioxidant and (f) thioether-series antioxidant will be described hereafter.

In the present invention, (e) phenol-series antioxidant and (f) thioether-series antioxidant are employed in order to provide the composition, which contains the base resin whose vinyl acetate content is 40 wt % or more and (d) the metal hydrate, with the excellent heat resistance that satisfies the heat aging test standard of UL 150° C.

In an insulated wire used as an internal wiring of electric/electronic equipment, generally, a composition that is coated on the conductor is crosslinked by the electron beam crosslinking method, in view of productivity. However, there is a problem that this method tends to consume a large amount of antioxidant, due to the generation of peroxyradical and hydroperoxide on a large scale at the time of electron beam irradiation. Accordingly, the amount of the antioxidant added to the composition in the present invention is more than ten times as much as the amount of an antioxidant blended to a non-crosslinked type composition.

(e) Phenol-series Antioxidant

Examples of the phenol-series antioxidant include triethylene glycol-bis(3-(3-t-butyl-5-methyl-4-hydroxyphenyl) propionate), 1,6-hexanediol-bis(3-(3,5-di-t-butyl-4-hydroxyphenyl)propionate), pentaerythrityl-tetrakis(3-(3,5-di-t-butyl-4-hydroxyphenyl)propionate), octadecyl-3-(3,5-di-t-butyl-4-hydroxyphenyl)propionate, 1,3,5-trimethyl-2,4,6-tris(3,5-di-t-butyl-4-hydroxybenzyl) benzene, tris(3,5-di-t-butyl-4-hydroxybenzyl)isocyanulate, and isooctyl-3-(3,5-di-t-butyl-4-hydroxyphenyl)propionate. Among the aforementioned examples, those having at least two groups selected from 3,5-di-t-butyl-4-hydroxyphenyl group, and 3,5-di-t-butyl-4-hydroxybenzyl group are preferable in terms of providing excellent heat resistance with the insulated wire. Tris(3,5-di-t-butyl-4-hydroxybenzyl) isocyanulate is especially preferable.

The amount of the phenol-series antioxidant to be blended in the present invention is generally 1 to 6 parts by weight, and preferably 2 to 4 parts by weight, with respect to 100 parts by weight of the base resin.

When the blended amount of the phenol-series antioxidant is too small, the effect of improving the heat resistance is hardly observed in the insulated wire after the crosslinking treatment. On the other hand, when the blended amount of the phenol-series antioxidant is too large, the effect of improving the heat resistance may reach the saturate state, and the tensile strength of the insulating material and the tensile elongation retained of the insulating material after the heat aging test may decrease due to the inhibition of crosslinking.

(f) Thioether-series Antioxidant

Examples of thioether-series antioxidant include dilauryl-3,3'-thiodipropionate, dimyristyl-3,3'-thiodipropionate, distearyl-3,3'-thiodipropionate, and pentaerythritoltetrakis (3-laurylthiopropionate). Among them, pentaerythritoltetrakis(3-laurylthiopropionate) is preferable in terms of providing excellent heat resistance with the insulated wire.

In the present invention, the amount of the thioether-series antioxidant to be blended is generally 12 to 30 parts by weight, preferably 14 to 24 parts by weight, with respect to 100 parts by weight of the base resin.

The thioether-series antioxidants are generally in the liquid state of have a relatively low melting point (30 to 70° C. or so), which is advantageous in terms of improving the dispersion property and the like of the antioxidant in the composition. However, when a large amount of the thioether-series antioxidant is blended to the composition, there generally arises a problem that the antioxidant is easily deposited on the surface of the composition, and thus mars the outer appearance of the insulated wire, and/or deteriorates the adhesion force between the conductor and the insulating material. In the present invention, by setting the content of vinyl acetate in the base resin at 40 wt % or more, the deposition of the thioether-series antioxidant is suppressed, and the adhesive property of the insulating material to metal can be improved. Accordingly, in the present invention, the problems that would occur when a large amount of the thioether-series antioxidant is blended (such as, the marred appearance of the insulated wire, and the deterioration of adhesion force between the conductor and the insulating material) can be prevented. In other words, in the present invention, it becomes possible to provide an insulated wire having excellent heat resistance that satisfies the heat aging test standard of UL 150 C, without causing the aforementioned problems.

When the blended amount of the thioether-series antioxidant is too small, the excellent heat resistance that satisfies the heat aging test standard of UL 150° C. cannot be provided to the insulated wire after crosslinked. On the other hand, when the blended amount of the thioether-series antioxidant is too large, not only the effect of improving the heat resistance reaches the saturated state, but also there may arise a case wherein the adhesion force between the conductor and the insulating material decrease, and a case wherein an insulated wire having the fire retardancy of the required degree cannot be obtained.

(g) Benzoimidazole-series Antioxidant

In the present invention, according to demand, the benzoimidazole-series antioxidant may be blended in order to prevent evaporation, transition or the like of other antioxidants used together.

Examples of the benzoimidazole-series antioxidant include, for example, 2-mercaptobenzoimidazole, 2-mercaptomethylbenzoimidazole, 4-mercaptomethylbenzoimidazole, 5-mercaptomethylbenzoimidazole, and zinc salts thereof.

The amount of the benzoimidazole-series antioxidant to be blended is generally 12 parts by weight or less, preferably 4 to 8 parts by weight, with respect to 100 parts by weight of the base resin.

When the blended amount of the benzoimidazole-series antioxidant is too large, the tensile strength retained of the insulating material after the aging test may increase and/or the tensile elongation retained of the insulating material after the heat aging test may decrease.

In the present invention, various additives that are conventionally used for insulated wires and cables (e.g., an antioxidant, a metal inactivating agent, a UV absorbing agent, a dispersing agent (e.g. stearic acid powder), a pigment, and the like) may be suitably blended to the composition that is coated on the conductor, according to demand, as long as such addition of additives does not adversely affect the object of the present invention.

The insulated wire of the present invention can be produced by: melt-kneading the composition containing the respective components, with a conventional kneading device, such as a banbury mixer, a kneader, and a roll; carrying out extrusion-coating of the kneaded composition around a conductor by using a general extrusion-coating device for producing electric wires; and then, crosslinking the coating layer.

The method to conduct crosslinking of the composition is not particularly limited, and crosslinking may be carried out either by a chemical crosslinking method or the electron beam crosslinking method. However, in terms of productivity, the crosslinking method by irradiation of electron beam is preferable.

In the case where the electron beam crosslinking method is employed to produce the insulated wire of the present invention, the dosage of the electron beam is preferably 5 to 25 Mrad, and the composition that will constitute the insulating layer may be blended with, as a crosslinking aid, a polyfunctional compound, such as a methacrylate-series compound (e.g. trimethylolpropane trimethacrylate), an allyl-series compound (e.g. triallyl cyanurate), a maleimide-series compound, and a divinyl-series compound.

The diameter of the conductor and the material of the conductor for the insulated wire of the present invention are not particularly limited, and they may be suitably determined in accordance with how the insulated wire is applied in actual use. The thickness of the insulating material (the coating layer) is not particularly limited, either, and it may be the same thickness to a usual coating layer. Further, an intermediate layer may be provided, for example, between the conductor and the insulating material formed with the aforementioned composition for coating. In other words, the coating layer may be structured as a multi-layered coating layer.

With respect to the tensile properties (tensile strength and tensile elongation of the insulating material) of the insulated wire of the present invention, there is no particular limitation. It is sufficient if the insulted wire of the present invention has those properties on levels which are generally required for a conventional insulated wire having a conductor diameter and a coating-layer thickness equivalent to those of the wire of the present invention. Generally, the tensile strength of the insulating material is 10.3 MPa or more, and the tensile elongation of the insulating material is 100% or more.

Further, the insulated wire of the present invention required to have the insulating material-tensile strength retained of 70% or more and insulating material-tensile elongation retained of 65% or more in heat aging test.

The insulating material-tensile strength retained sometimes exceeds 100% after the heat aging test, because the crosslinking of the composition proceeds due to the heat. However, the insulating material-tensile strength of 150% or more is not preferable, because pliability of the composition is deteriorated.

The insulated wire of the present invention has excellent fire retardancy and tensile properties, as well as excellent heat resistance that satisfies the heat aging test standard of UL 150° C. In addition, the insulated wire of the present invention has an excellent adhesion property between the conductor and the insulating material (the coating layer), whereby the processability in the terminal processing steps, in which the conductor is exposed by a predetermined length by peeling the insulation coating off, and then connected to a terminal or the like, is excellent.

The insulated wire of the present invention, which has the aforementioned excellent properties, does not allow either dissolution of heavy metal compounds or emission of much smoke and corrosive gas at the time of disposal, including reclamation and incineration. Accordingly, the insulated wire of the present invention can be suitably used for the internal wiring of electric/electronic equipment.

EXAMPLES

Hereinafter, the present invention will be described further in detail based on examples.

Examples 1 to 8 and Comparative Examples 1 to 3

The respective components were dry blended at the ratios shown in Table 1 at the room temperature. The blended components were melt-kneaded by using a banbury mixer, whereby the respective compositions for forming the insulation material were obtained.

Next, by using a general-purpose extruder for producing electric wires, each of the obtained compositions was extrusion coated on a tin-plated annealed copper wire having the conductor diameter of 0.48 mmϕ (composed of seven wires each having a diameter of 0.16 mmϕ), so that the thickness of the coating became 0.42 mm, whereby an insulated wire that had not been subjected to crosslinking, was produced. Thereafter, electron beam of 10 Mrad was irradiated on the obtained insulated wire.

As the components shown in Table 1, the following products were used.

(01) Ethylene/vinyl acetate copolymer

Levapren 800HV (trade name, manufactured by Bayer Ltd.)

Content of vinyl acetate 80 wt %

(02) Ethylene/vinyl acetate copolymer

Evaflex EV40LX (trade name, manufactured by Du Pont Mitsui Polychemicals Co., Ltd.)

Content of vinyl acetate 40 wt %

(03) Modified polyethylene

Adtex L6100M (trade name, manufactured by Japan Polyolefins Co., Ltd.)

(04) Ethylene acryl rubber

Vamac GLS (trade name, manufactured by Du Pont Co.)

(05) Magnesium hydroxide

Kisuma 5PH (trade name, manufactured by Kyowa Chemical Industry Co., Ltd.)

(06) Phenol-series antioxidant

Adecastab AO-20 (trade name, manufactured by Asahi Denka Kogyo K.K.)

Tris(3,5-di-t-butyl-4-hydroxybenzyl)isocyanulate

(07) Thioether-series antioxidant

Adecastab AO-412S (trade name, manufactured by Asahi Denka Kogyo K.K.)

Pentaerythritoltetrakis(3-laurylthiopropionate)

(08) Benzoimidazole-series antioxidant

Nocrac MB (trade name, manufactured by Ouchi Shinko Kagaku Kogyo Co.)

2-mercaptobenzoimidazole

(09) Stearic acid powder

Sakura (trade name, manufactured by NOF CORPORATION)

(10) Trimethylolpropanetrimethacrylate

Ogmont T200 (trade name, manufactured by Shin-Nakamura Chemical Co., Ltd.)

Each of the obtained wires was subjected to the following tests. The results are shown in Table 1.

1) Tensile Properties Test

The tensile strength (MPa) and the tensile elongation (%) of the insulating material of the obtained insulated wire were measured with gauge marks of 25 mm (i.e., the length between the gauge marks was 25 mm), and at a tensile testing speed of 500 mm/minute.

According to the UL Standard, a sample that exhibited tensile strength of 10.3 MPa or more, and tensile elongation of 100% or more, was evaluated as "○."

2) Heat Resistance (Heat Aging Property) Test

The tensile strength and the tensile elongation of each insulating material were measured after exposing the wire to a temperature of 180° C. for seven days, according to the UL Standard. A sample having the insulating material-tensile strength retained rate of 70% or more, and the insulating material-tensile elongation retained rate of 65% or more, was evaluated as "○." It should be noted that the insulating material-tensile strength retained rate sometimes exceeds 100% after the heat aging test, because the crosslinking of the composition proceeds due to the heat. (the heat aging test of UL 150° C.)

3) Fire Retardancy Test

A horizontal flame test according to JIS C3005, and a UL VW-1 vertical flame test, were carried out for each insulated wire. A sample that passed the test was evaluated as "○" for each of the above two flame tests. In the fire retardancy test, a sample did not need to pass both of the two flame tests; and it was considered that the sample passed the fire retardancy test if the sample passed the horizontal flame test.

4) Terminal Processability Test

The coating at each end of each insulated wire was peeled off, by 10 mm, using a casting machine, to prepare samples each having insulating material with a length of 600 mm.

Samples in which the residual coating, in the portion of the ends subjected to the peeling, was no thicker than 0.5 mm after the removal of the coating, were evaluated as "○" Samples whose coating could not be removed, samples whose residual coating exceeded 0.5 mm, and samples whose length of the insulating material failed to be 600 mm, were evaluated as "X."

The state of removal of the coating, and the length of the insulated portion of the wire, are correlated with the operation efficiency in terminal processing steps, and the absence/presence of the residual coating is correlated with whether or not contact failure occurs at the time of connecting a terminal to the insulated wire.

5) Electric Property (Underwater Insulation Resistance) Test

Each insulated wire (50 m long) was immersed in water at 20° C. for 1 hour. A direct current voltage of 500 V was applied between the conductor and water for 1 minute, and the insulation resistance was measured. The measured insulation resistance was converted into a value per 1 km, for evaluation.

A sample that exhibited a converted value of 100 MΩ·km or more was considered to be reached at a satisfying level (the insulation resistance test according to JIS C 3005).

TABLE 1

| | Example 1 | Example 2 | Example 3 | Example 4 | Example 5 | Example 6 | Example 7 | Example 8 |
|---|---|---|---|---|---|---|---|---|
| Composition (parts by weight) | | | | | | | | |
| (01) Ethylene/vinyl acetate copolymer | 40 | 40 | 40 | 40 | 40 | 40 | 60 | 20 |
| (02) Ethylene/vinyl acetate copolymer | 60 | 60 | 60 | 60 | 50 | 50 | 40 | 80 |
| (03) Modified polyethylene | | | | | 10 | | | |
| (04) Ethylene acryl rubber | | | | | | 10 | | |
| (05) Magnesium hydroxide | 240 | 240 | 240 | 240 | 240 | 240 | 240 | 240 |
| (06) Phenol-series antioxidant | 2 | 2 | 2 | 2 | 2 | 2 | 2 | 2 |
| (07) Thioether-series antioxidant | 20 | 20 | 14 | 28 | 20 | 20 | 20 | 20 |
| (08) Benzoimidazole-series antioxidant | | 4 | 4 | 4 | 4 | 4 | 4 | |
| (09) Stearic acid powder | 2 | 2 | 2 | 2 | 2 | 2 | 2 | 2 |
| (10) Trimethylolpropane trimethacrylate | 6 | 6 | 6 | 6 | 6 | 6 | 6 | 6 |
| Vinyl acetate content in base resin ((1) to (4)) (wt %) | 56 | 56 | 56 | 56 | 52 | 52 | 64 | 48 |
| Tensile properties | | | | | | | | |
| Evaluation | ○ | ○ | ○ | ○ | ○ | ○ | ○ | ○ |
| Tensile strength of insulating material (MPa) | 10.8 | 11.2 | 12.2 | 10.4 | 12.4 | 11.4 | 12.2 | 10.6 |
| Tensile elongation of insulating material (%) | 140 | 140 | 130 | 160 | 120 | 110 | 120 | 140 |
| Heat aging properties (180° C. × 7 days) | | | | | | | | |
| Evaluation | ○ | ○ | ○ | ○ | ○ | ○ | ○ | ○ |
| Tensile strength retained of insulating material (%) | 111 | 119 | 125 | 117 | 116 | 125 | 110 | 107 |
| Tensile elongation retained of insulating material (%) | 71 | 79 | 69 | 81 | 83 | 73 | 75 | 91 |
| Fire retardancy | | | | | | | | |
| JIS C3005 Horizontal flame test | ○ | ○ | ○ | ○ | ○ | ○ | ○ | ○ |
| UL VW-1 Inclined flame test | X | X | X | X | X | X | ○ | X |
| Terminal processability | ○ | ○ | ○ | ○ | ○ | ○ | ○ | ○ |
| Electric property (MΩ·km) (Underwater insulation resistance) | | | | | | | | |
| after 20° C. × 1 hour immersion | 160 | — | — | — | — | — | — | 118 |

(Note)
"–"means no test was conducted.

TABLE 2

| | Comparative example 1 | Comparative example 2 | Comparative example 3 |
|---|---|---|---|
| Composition (parts by weight) | | | |
| (01) Ethylene/vinyl acetate copolymer | 40 | 40 | |
| (02) Ethylene/vinyl acetate copolymer | 60 | 60 | 80 |
| (03) Modified polyethylene | | | 20 |
| (04) Ethylene acryl rubber | | | |
| (05) Magnesium hydroxide | 240 | 240 | 240 |
| (06) Phenol-series antioxidant | 2 | 2 | 2 |
| (07) Thioether-series antioxidant | 8 | 34 | 20 |
| (08) Benzoimidazole-series antioxidant | | | |
| (09) Stearic acid powder | 2 | 2 | 2 |
| (10) Trimethylolpropane trimethacrylate | 6 | 6 | 6 |
| Vinyl acetate content in base resin ((1) to (4)) (wt %) | 56 | 56 | 32 |
| Tensile properties | | | |
| Evaluation | ○ | X | ○ |
| Tensile strength of insulating material (MPa) | 12.8 | 8.8 | 12.2 |
| Tensile elongation of insulating material (%) | 160 | 180 | 180 |
| Heat aging properties (180° C. × 7 days) | | | |
| Evaluation | X | ○ | ○ |
| Tensile strength retained of insulating material (%) | 177 | 116 | 104 |
| Tensile elongation retained of insulating material (%) | 25 | 77 | 91 |

TABLE 2-continued

| | Comparative example 1 | Comparative example 2 | Comparative example 3 |
|---|---|---|---|
| Fire retardancy | | | |
| JIS C3005 Horizontal flame test | ○ | ○ | ○ |
| UL VW-1 Inclined flame test | X | X | X |
| Terminal processability | ○ | X | X |
| Electric property (Underwater insulation resistance) | | | |
| after 20° C. × 1 hour immersion (M Ω · km) | — | — | 68 |

(Note) "—" means no test was conducted.

From the results shown in Table 1, it is understood that all of the insulated wires of Examples 1 to 8, according to the present invention, exhibited excellent tensile properties, heat aging properties, fire retardancy, terminal processing workability, and underwater insulation resistance property.

On the other hand, from the results shown in Table 2, it is understood that the insulated wire of Comparative example 3, in which the vinyl acetate content in the base resin was less than 40 wt %, and the insulated wire of Comparative example 2, in which the thioether-series antioxidant content exceeded 30 wt %, both had a problem in terminal processability due to deterioration of the adhesion force between the conductor and the insulating material. In addition, Comparative example 3 was further evaluated for underwater insulation resistance, however, it attained very low value as to be problematic.

Further, Comparative example 1, in which the content of the thioether-series antioxidant was less than 12 parts by weight, had a problem in the heat aging properties.

Having described our invention as related to the present embodiments, it is our intention that the invention not be limited by any of the details of the description, unless otherwise specified, but rather be construed broadly within its spirit and scope as set out in the accompanying claims.

What is claimed is:

1. An insulated wire, in which a conductor is coated with a crosslinked product of a composition, which composition comprises in a proportion:

100 parts by weight of a base resin containing an ethylene/vinyl acetate copolymer, 150 to 300 parts by weight of a metal hydrate, 1 to 6 parts by weight of a phenol-series antioxidant, and 12 to 30 parts by weight of a thioether-series antioxidant;

the content of vinyl acetate in the base resin being 40 wt % or more.

2. The insulated wire as claimed in claim 1, wherein the composition contains, 12 parts by weight or less of a benzoimidazole-series antioxidant per 100 parts by weight of the base resin.

3. The insulated wire as claimed in claim 1, wherein the base resin of the composition contains ethylene acryl rubber, in the amount of 30 wt % or less of the base resin.

4. The insulated wire as claimed in claim 1, wherein the metal hydrate is surface-treated with a silane coupling agent.

5. The insulated wire as claimed in claim 1, wherein the metal hydrate is magnesium hydroxide.

6. The insulated wire as claimed in claim 1, wherein 20 wt % or more of the ethylene/vinyl acetate copolymer is an ethylene/vinyl acetate copolymer having a structure in which three or more of the vinyl acetate component, as a component of the copolymer, are continuously linked.

7. The insulated wire as claimed in claim 1, wherein a melt flow rate of the ethylene/vinyl acetate copolymer is 0.1 to 10 g/10 minutes (at load of 21.18 N, and temperature of 190° C.).

8. The insulated wire as claimed in claim 1, wherein the composition is crosslinked by irradiating electric beam.

9. An insulated wire, in which a conductor is coated with a crosslinked product of a composition, which composition comprises in a proportion:

100 parts by weight of a base resin containing an ethylene/vinyl acetate copolymer, 150 to 300 parts by weight of a metal hydrate, 1 to 6 parts by weight of a phenol-series antioxidant, and 12 to 30 parts by weight of a thioether-series antioxidant;

the content of vinyl acetate in the base resin being 50 to 70 wt %, wherein the coating on the wire retains, after a heat aging test at 180° C. for 168 hours, a tensile strength of 70% or more, and a tensile elongation of 65% or more.

10. An insulated wire, in which a conductor is coated with a crosslinked product of a composition, which composition comprises in a proportion:

100 parts by weight of a base resin containing an ethylene/vinyl acetate copolymer, 180 to 240 parts by weight of a metal hydrate, 2 to 4 parts by weight of a phenol-series antioxidant, and 14 to 24 parts by weight of a thioether-series antioxidant;

the content of vinyl acetate in the base resin being 50 to 70 wt %, and wherein the coating on the wire retains, after a heat aging test at 180° C. for 168 hours, a tensile strength of 70% or more, and a tensile elongation of 65% or more.

11. An insulated wire, in which a conductor is coated with a crosslinked product of a composition, which composition comprises in a proportion:

100 parts by weight of a base resin containing an ethylene/vinyl acetate copolymer, 180 to 240 parts by weight of a metal hydrate, 2 to 4 parts by weight of a phenol-series antioxidant, 14 to 24 parts by weight of a thioether-series antioxidant, and 4 to 8 parts by weight of benzoimidazole-series antioxidant;

the content of vinyl acetate in the base resin being 50 to 70 wt %, and wherein the coating on the wire retains, after a heat aging test at 180° C. for 168 hours, a tensile strength of 70% or more, and a tensile elongation of 65% or more.

12. An insulated wire, in which a conductor is coated with a crosslinked product of a composition, which composition comprises in a proportion:

100 parts by weight of a base resin containing an ethylene/vinyl acetate copolymer, 180 to 240 parts by weight of a metal hydrate that is surface-treated with a silane coupling agent, 2 to 4 parts by weight of a phenol-series antioxidant containing at least two groups selected from 3,5-di-t-butyl-4-hydroxyphenyl group, and 3,5-di-t-butyl-4-hydroxybenzyl group, and 14 to 24 parts by weight of a thioether-series antioxidant selected from the group consisting of dilauryl-3,3'-thiodipropionate, dimyristyl-3,3'-thiodipropionate, distearyl-3,3'-thiodipropionate, and pentaerythritoltetrakis(3-laurylthiopropionate);

the content of vinyl acetate in the base resin being 50 to 70 wt %, and wherein the coating on the wire retains, after a heat aging test at 180° C. for 168 hours, a tensile strength of 70% or more, and a tensile elongation of 65% or more.

* * * * *